US009638199B2

(12) United States Patent
Beers et al.

(10) Patent No.: US 9,638,199 B2
(45) Date of Patent: May 2, 2017

(54) RAM AIR FAN INLET SHROUD

(71) Applicant: Hamilton Sundstrand Corporation, Windsor Locks, CT (US)

(72) Inventors: Craig M. Beers, Wethersfield, CT (US); Darryl A. Colson, West Suffield, CT (US); Clarence J. Wytas, Stafford Springs, CT (US)

(73) Assignee: HAMILTON SUNDSTRAND CORPORATION, Windsor Locks, CT (US)

( * ) Notice: Subject to any disclaimer, the term of this patent is extended or adjusted under 35 U.S.C. 154(b) by 942 days.

(21) Appl. No.: 13/871,267

(22) Filed: Apr. 26, 2013

(65) Prior Publication Data

US 2014/0321995 A1 Oct. 30, 2014

(51) Int. Cl.

| | |
|---|---|
| ***F04D 25/08*** | (2006.01) |
| ***F04D 29/32*** | (2006.01) |
| ***F04D 29/58*** | (2006.01) |
| ***F04D 19/00*** | (2006.01) |
| ***F04D 25/06*** | (2006.01) |

(52) U.S. Cl.

CPC ..... *F04D 25/082* (2013.01); *F04D 19/00* (2013.01); *F04D 25/06* (2013.01); *F04D 29/329* (2013.01); *F04D 29/5806* (2013.01); *Y10T 29/49316* (2015.01)

(58) Field of Classification Search

CPC .... F04D 25/082; F04D 29/326; F04D 29/329; F04D 29/5806

See application file for complete search history.

(56) References Cited

U.S. PATENT DOCUMENTS

| | | | | |
|---|---|---|---|---|
| 5,124,600 | A * | 6/1992 | Hedeen | H02K 9/06 310/51 |
| 7,402,020 | B2 | 7/2008 | Beers et al. | |
| 7,757,502 | B2 | 7/2010 | Merritt et al. | |
| 2008/0317586 | A1* | 12/2008 | Kuma | F04D 25/082 415/119 |
| 2012/0014784 | A1 | 1/2012 | Hipsky et al. | |

(Continued)

FOREIGN PATENT DOCUMENTS

| | | |
|---|---|---|
| EP | 0474019 | 3/1992 |
| SU | 1138546 | 2/1985 |

OTHER PUBLICATIONS

CN Patent Application No. 201410169919.3 First Office Action, Issued Feb. 4, 2017, 6 pages.

*Primary Examiner* — Christopher Verdier
*Assistant Examiner* — Brian O Peters
(74) *Attorney, Agent, or Firm* — Cantor Colburn LLP

(57) ABSTRACT

A ram air fan inlet shroud for a ram air fan assembly is provided. The ram air fan inlet shroud includes a shroud portion extending outwardly from a conical portion. The conical portion provides a transition between a central portion and an inner ram air fan hub interface portion. The conical portion includes a plurality of inner cooling slots having a slot arc length and spaced apart by a slot spacing angle. A ratio of the slot spacing angle to the slot arc length is between about 1.24 and 1.4. The ram air fan inlet shroud also includes a recessed portion located between the inner ram air fan hub interface portion and an outer ram air fan hub interface portion. The recessed portion includes a plurality of outer cooling holes.

9 Claims, 4 Drawing Sheets

(56) References Cited

U.S. PATENT DOCUMENTS

| | | | | |
|---|---|---|---|---|
| 2013/0022443 | A1 | 1/2013 | Beers et al. | |
| 2014/0056718 | A1* | 2/2014 | Beers | F04D 25/082 416/97 R |

* cited by examiner

RAM AIR FAN INLET SHROUD

BACKGROUND OF THE INVENTION

The subject matter disclosed herein relates to aircraft environmental control. More specifically, the subject disclosure relates to an inlet shroud of a ram air fan for an aircraft environmental control system.

Many types of aircraft use ram air flow for various purposes, such as in cooling systems for the aircraft. For example, the ram air flow may be utilized to remove heat from various aircraft lubrication and electrical systems and/or used to condition aircraft cabin air. When the aircraft is in flight, movement of the aircraft creates a sufficient source of ram air flow which can be used for the purposes described above. When the aircraft is on the ground or is operating at low speeds, a ram air fan is typically utilized to increase air flow to the cooling systems. Such a ram air fan is driven by an electric motor which, in turn, must be cooled by air flowing across it. Cooling flow is drawn at a heat exchanger inlet and across the electric motor to a ram air fan inlet. The flow of cooling air, and thus the performance of the electric motor and ram air fan, is typically limited by a pressure drop from the heat exchanger inlet to the ram air fan inlet. A balance must be achieved between this pressure drop, which can impact heat exchanger performance, and providing sufficient cooling flow to the electric motor and other components of a ram air fan assembly.

BRIEF DESCRIPTION OF THE INVENTION

According to one aspect of the invention, a ram air fan inlet shroud for a ram air fan assembly is provided. The ram air fan inlet shroud includes a shroud portion extending outwardly from a conical portion. The conical portion provides a transition between a central portion and an inner ram air fan hub interface portion. The conical portion includes a plurality of inner cooling slots having a slot arc length and spaced apart by a slot spacing angle. A ratio of the slot spacing angle to the slot arc length is between about 1.24 and 1.4. The ram air fan inlet shroud also includes a recessed portion located between the inner ram air fan hub interface portion and an outer ram air fan hub interface portion. The recessed portion includes a plurality of outer cooling holes.

According to another aspect of the invention, a ram air fan assembly includes a ram air fan disposed at a fan inlet. The ram air fan includes a ram air fan hub coupled to a plurality of fan blades. A ram air fan motor is operably connected to the ram air fan. The ram air fan assembly also includes a ram air fan inlet shroud disposed proximate to the ram air fan hub. The ram air fan inlet shroud includes a shroud portion extending outwardly from a conical portion. The conical portion provides a transition between a central portion and an inner ram air fan hub interface portion. The conical portion includes a plurality of inner cooling slots having a slot arc length and spaced apart by a slot spacing angle. A ratio of the slot spacing angle to the slot arc length is between about 1.24 and 1.4. The ram air fan inlet shroud also includes a recessed portion located between the inner ram air fan hub interface portion and an outer ram air fan hub interface portion. The recessed portion includes a plurality of outer cooling holes.

According to a further aspect of the invention, a method of installing a ram air fan inlet shroud in a ram air fan assembly is provided. The ram air fan inlet shroud is arranged proximate to a ram air fan hub coupled to a plurality of fan blades. The fan blades are configured to extend at least partially across a ram air fan inlet of the ram air fan assembly. A tie rod is positioned through the ram air fan inlet shroud and the ram air fan hub along a ram air fan centerline within an interior portion of a ram air fan shaft. A plurality of flow paths for a cooling flow in the ram air fan assembly is established including through a plurality of inner cooling slots and outer cooling holes in the ram air fan inlet shroud. The ram air fan inlet shroud also includes a shroud portion extending outwardly from a conical portion. The conical portion provides a transition between a central portion and an inner ram air fan hub interface portion. The conical portion includes the plurality of inner cooling slots having a slot arc length and spaced apart by a slot spacing angle. A ratio of the slot spacing angle to the slot arc length is between about 1.24 and 1.4. The ram air fan inlet shroud further includes a recessed portion located between the inner ram air fan hub interface portion and an outer ram air fan hub interface portion. The recessed portion includes the plurality of outer cooling holes.

The detailed description explains embodiments of the invention, together with advantages and features, by way of example with reference to the drawings.

DETAILED DESCRIPTION OF THE INVENTION

Figure 1:
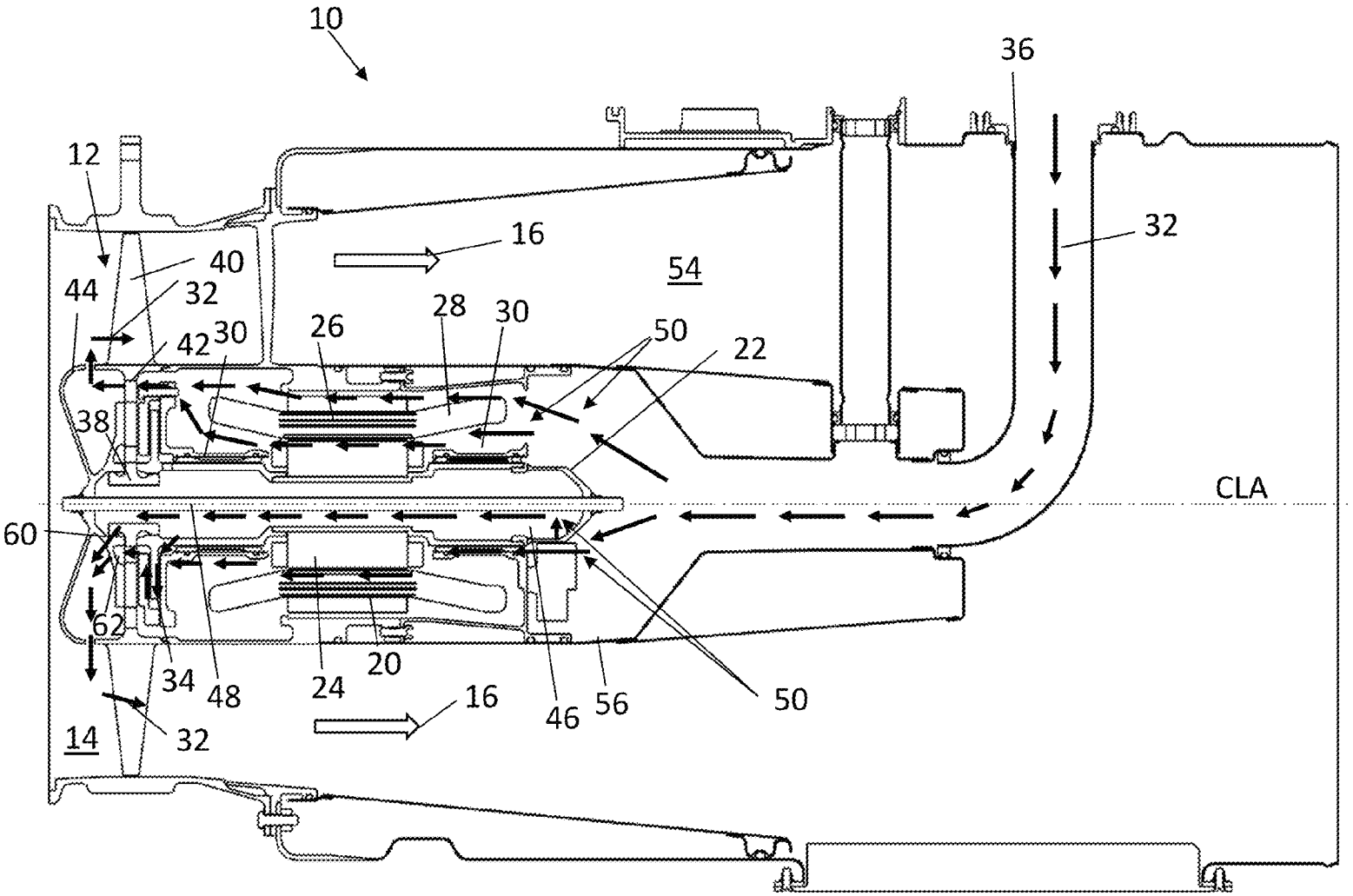
FIG. 1 is a view of an embodiment of a ram air fan assembly including a ram air fan inlet shroud.

Shown in FIG. 1 is a view of a ram fan assembly 10 for an aircraft environmental control system (ECS). The ram fan assembly 10 includes a ram air fan (RAF) 12 located at a RAF inlet 14. A ram air flow 16 flows into the RAF inlet 14 and through a fan passage 54 to a heat exchanger (not depicted) and/or overboard.

The RAF 12 includes fan blades 40 that are coupled to a RAF hub 38, where the RAF hub 38 is operably connected to a RAF motor 20 via a RAF shaft 22. The RAF motor 20, located in a motor housing 56, is an electric motor having a rotor 24 rotably located at the RAF shaft 22, and a stator 26 having a plurality of stator windings 28 disposed radially outboard of the rotor 24. The RAF motor 20 also includes one or more journal bearings 30 disposed at the RAF shaft 22. The RAF 12 and RAF motor 20 are typically utilized to urge additional air flow 16 through the RAF inlet 14 when natural airflow 16 into the RAF inlet 14 is not sufficient to meet airflow requirements.

To prevent overheating of the RAF motor 20, particularly the stator windings 28, the journal bearings 30, and one or more thrust bearings 34, a cooling flow 32 is drawn through the motor housing 56 across the RAF motor 20. The cooling flow 32 is drawn through an inlet header 36. The cooling flow 32 proceeds through a plurality of flow paths 50 that include flow across the journal bearings 30, stator windings 28, stator 26, and rotor 24 to remove thermal energy therefrom. The flow paths 50 allow the cooling flow 32 to pass through a plurality of cooling openings 42 in a RAF hub 38 and egress from the RAF motor 20 toward the RAF inlet 14.

The cooling flow 32 is also routed by flow paths 50 in proximity to the thrust bearings 34. Additionally, the cooling flow 32 in the flow paths 50 enters an interior portion 46 of the RAF shaft 22 that includes a tie rod 48 positioned along a ram air fan centerline (CLA). The cooling flow 32 in the flow paths 50 also passes through a plurality of inner cooling slots 60 and outer cooling holes 62 of a RAF inlet shroud 44 toward the RAF inlet 14. The RAF inlet shroud 44 is disposed proximate to the RAF hub 38. In an embodiment, the inner cooling slots 60 are configured to receive of portion of the cooling air 32 that passes through the interior portion 46 of the RAF shaft 22, while the outer cooling holes 62 are configured to receive a portion of the cooling flow 32 that cools the thrust bearings 34.

The cooling flow 32 enters the RAF inlet 14 between the RAF inlet shroud 44 and the fan blades 40 that are coupled to the RAF hub 38 to mix with the airflow 16. The cooling flow 32 is driven generally via a pressure differential between the inlet header 36 and the RAF inlet 14 and the configuration of the flow paths 50.

Figure 2:
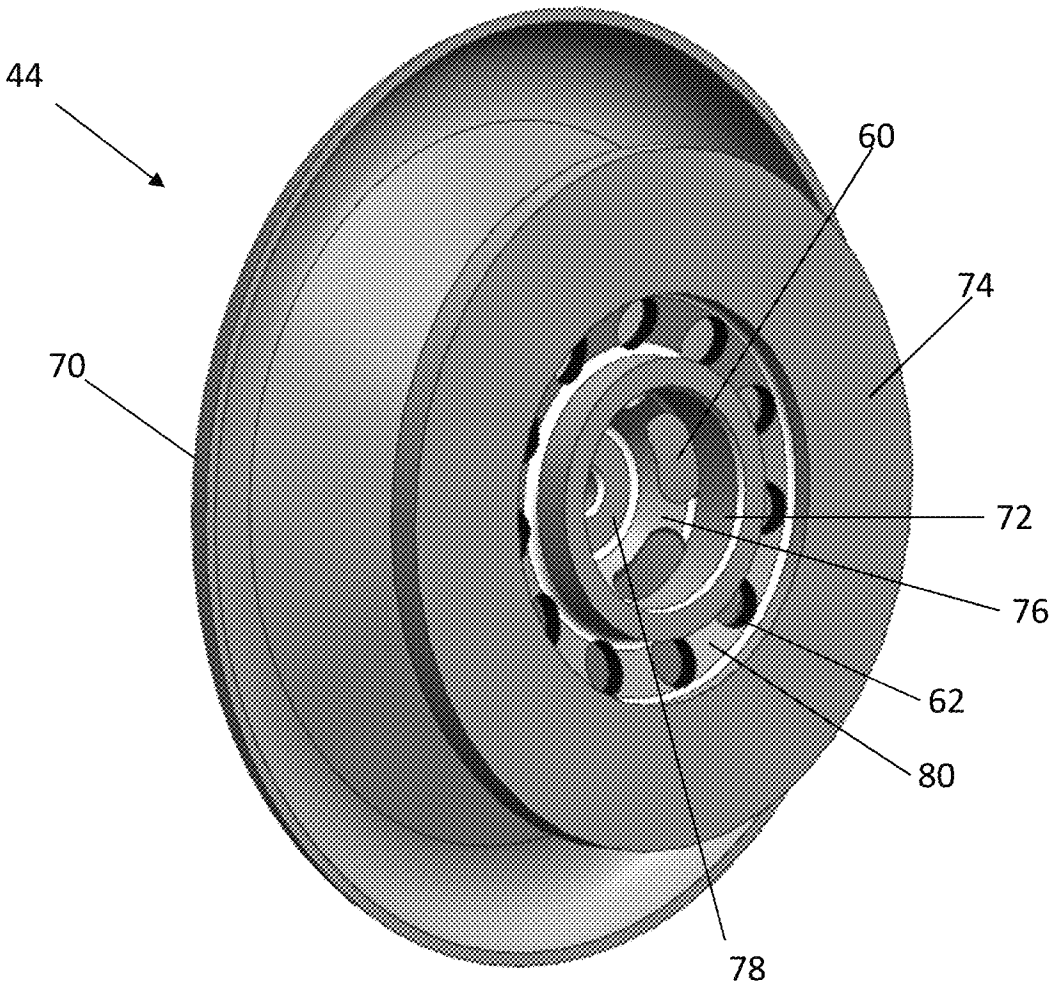
FIG. 2 is a perspective view of an embodiment of the ram air fan inlet shroud of FIG. 1.

FIG. 2 is a perspective view of an embodiment of the RAF inlet shroud 44 of FIG. 1. The RAF inlet shroud 44 includes a shroud portion 70, an inner RAF hub interface portion 72, an outer RAF hub interface portion 74, a conical portion 76, a central portion 78, and a recessed portion 80. The conical portion 76 of the RAF inlet shroud 44 provides a transition between the inner RAF hub interface portion 72 and the central portion 78 of the RAF inlet shroud 44. The shroud portion 70 extends outwardly from the conical portion 76 of the RAF inlet shroud 44. The recessed portion 80 is located between the inner RAF hub interface portion 72 and the outer RAF hub interface portion 74, which gives the inner RAF hub interface portion 72 an annular appearance. The inner cooling slots 60 are located in the conical portion 76 of the RAF inlet shroud 44, and the outer cooling holes 62 are located in the recessed portion 80 of the RAF inlet shroud 44. As can be seen in FIG. 2, each of the inner cooling slots 60 has a substantially elongated kidney shape, while each of the outer cooling holes 62 is substantially round. The number, sizing, and placement of the inner cooling slots 60 and the outer cooling holes 62 assist in optimizing the cooling flow 32 of FIG. 1, and thereby improve performance of the RAF assembly 10 of FIG. 1 and associated aircraft ECS.

Figure 3:
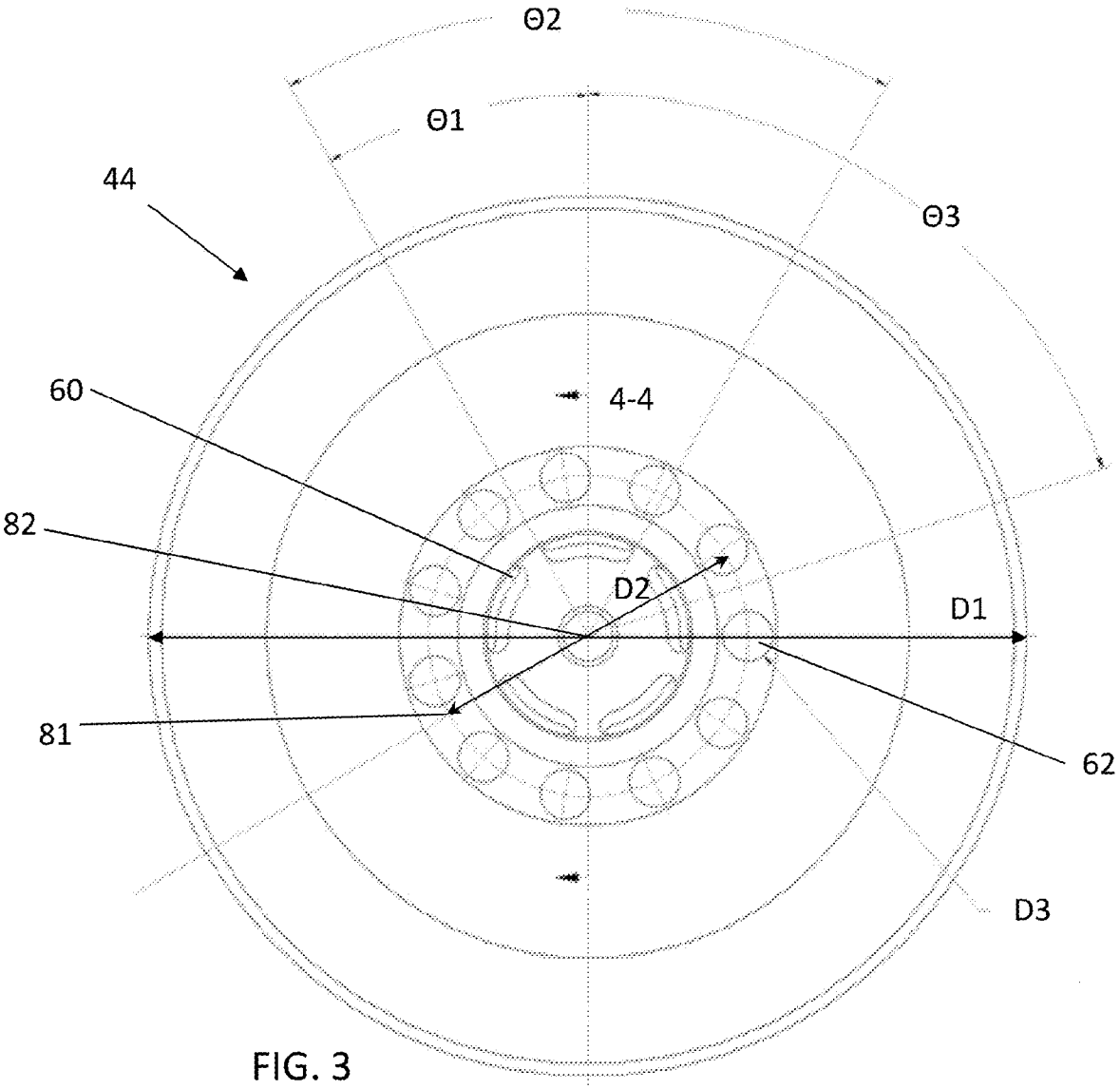
FIG. 3 is a view of the ram air fan inlet shroud of FIG. 1.

FIG. 3 is a view of the RAF inlet shroud 44 of FIG. 1. In the embodiment of FIG. 3, the RAF inlet shroud 44 includes five substantially equally spaced inner cooling slots 60, where each of the inner cooling slots 60 is substantially symmetric about an angle Θ1 of about 28.50 degrees and spanning a slot arc length Θ2 of about 57.00 degrees. Each of the inner cooling slots 60 is spaced apart by a slot spacing angle Θ3 of about 72.00 degrees, e.g., as measured between adjacent slot centers. A ratio of the slot spacing angle Θ3 to the slot arc length Θ2 is between about 1.23 and 1.4. A total inner cooling area provided by the five inner cooling slots 60 is about 0.915 square inches (5.903 square cm).

The RAF inlet shroud 44 of FIG. 3 has a diameter D1 of about 6.6 inches (16.76 cm). As can be seen in FIG. 3, the RAF inlet shroud 44 includes eleven substantially equally spaced outer cooling holes 62. The outer cooling holes 62 are positioned around an outer cooling hole placement circle 81 having a diameter D2 of about 2.4 inches (6.10 cm). The outer cooling hole placement circle 81 is centered at an axial center 82 of the RAF inlet shroud 44. Each of the outer cooling holes 62 has a diameter D3 of about 0.375 inches (0.9525 cm). A total outer cooling area provided by the eleven outer cooling holes 62 is about 1.215 square inches (7.838 square cm). In an embodiment, a ratio of the total outer cooling area of the outer cooling holes 62 to the total inner cooling area of the inner cooling slots 60 is between about 1.242 and 1.419.

Figure 4:
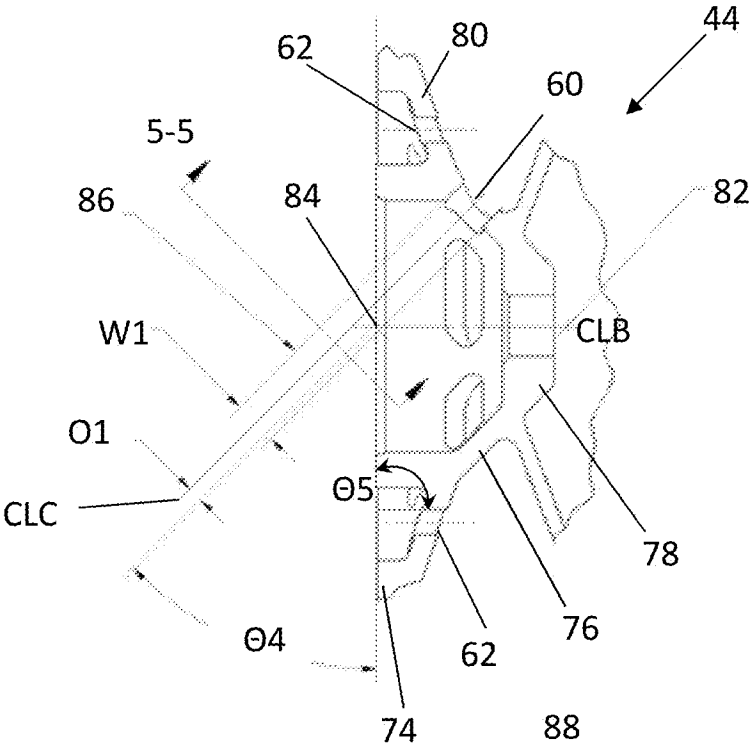
FIG. 4 is a sectional view of the ram air fan inlet shroud of FIG. 1.

FIG. 4 is a sectional view of the RAF inlet shroud 44 taken at sectional line 4-4 of FIG. 3 and illustrated about a RAF inlet shroud centerline (CLB) along the axial center 82 of the RAF inlet shroud 44 proximate the central portion 78. The RAF inlet shroud centerline CLB intersects an origin point 84 along the axial center 82 of the RAF inlet shroud 44 that is flush with the outer RAF hub interface portion 74. Projections 86 of one of the inner cooling slots 60 in the conical portion 76 of the RAF inlet shroud 44 are depicted in FIG. 4, where a slot centerline (CLC) has an offset (O1) of about 0.100 inches (0.254 cm) from the origin point 84 intersection with the RAF inlet shroud centerline CLB. A width (W1) of the inner cooling slots 60 is about 0.28 inches (0.711 cm). Relative to the origin point 84, each of the inner cooling slots 60 is formed at an angle Θ4 of about 45 degrees. Each of the outer cooling holes 62 in the recessed portion 80 of the RAF inlet shroud 44 is substantially normal to the outer RAF hub interface portion 74, having an angle Θ5 of about 90 degrees relative to the origin point 84. In an embodiment, a ratio of the angle Θ5 to the angle Θ4 is between about 1.87 and 2.14.

Figure 5:
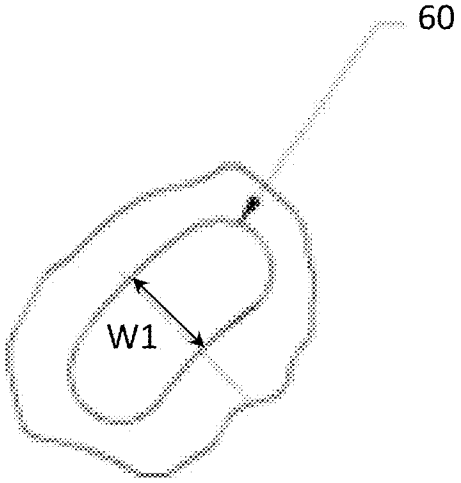
FIG. 5 is a view of an inner cooling slot of the ram air fan inlet shroud of FIG. 1.

FIG. 5 is a view of an inner cooling slot 60 of the RAF inlet shroud 44 taken at sectional line 5-5 of FIG. 4. FIG. 5 better depicts the elongated kidney shape of the inner cooling slot 60 and the width W1.

Referring back to FIG. 1, a process of installing the RAF inlet shroud 44 in the RAF assembly 10 includes arranging the RAF inlet shroud 44 proximate to the RAF hub 38 coupled to the fan blades 40, where the fan blades 40 are configured to extend at least partially across the RAF inlet 14 of the RAF assembly 10. The tie rod 48 is positioned through the RAF inlet shroud 44 and the RAF hub 38 along the RAF centerline CLA within the interior portion 46 of the RAF shaft 22. Flow paths 50 for the cooling flow 32 are established in the RAF assembly 10, including through the inner cooling slots 60 and the outer cooling holes 62 in the RAF inlet shroud 44. The flow paths 50 are also configured to route the cooling flow 32 through the cooling openings 42 in the RAF hub 38. The tie rod 48 is secured to the RAF shaft 22 and the RAF inlet shroud 44.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A ram air fan inlet shroud for a ram air fan assembly for an aircraft, the ram air fan inlet shroud comprising:

a shroud portion extending outwardly from a conical portion, the conical portion providing a transition between a central portion and an inner ram air fan hub interface portion, the conical portion comprising a plurality of inner cooling slots having a substantially elongated kidney shape with a slot arc length and spaced apart by a slot spacing angle, wherein a ratio of the slot spacing angle to the slot arc length is between 1.23 and 1.4;

a recessed portion located between the inner ram air fan hub interface portion and an outer ram air fan hub interface portion, the recessed portion comprising a plurality of outer cooling holes that are each substantially circular, wherein a ratio of a total outer cooling area of the outer cooling holes to a total inner cooling area of the inner cooling slots is between 1.242 and 1.419; and a ram air fan inlet shroud centerline and an origin point that is flush with the outer ram air fan hub interface portion along the ram air fan inlet shroud centerline, and a slot centerline of each of the inner cooling slots is offset from the origin point, wherein a ratio of an angle of each of the outer cooling holes to the origin point and an angle of each of the inner cooling slots to the origin point is between 1.87 and 2.14.

2. The ram air fan inlet shroud of claim 1, wherein the offset is 0.100 inches (0.254 cm), and a width of each of the inner cooling slots is 0.28 inches (0.711 cm).

3. The ram air fan inlet shroud of claim 1, wherein the outer cooling holes comprise eleven equally spaced holes, each having a diameter of 0.375 inches (0.9525 cm) and positioned around an outer cooling hole placement circle having a diameter of 2.4 inches (6.10 cm).

4. A ram air fan assembly for an aircraft, the ram air fan assembly comprising:

a ram air fan disposed at a fan inlet, the ram air fan comprising a ram air fan hub coupled to a plurality of fan blades;

a ram air fan motor operably connected to the ram air fan; and a ram air fan inlet shroud disposed proximate to the ram air fan hub, the ram air fan inlet shroud comprising:

a shroud portion extending outwardly from a conical portion, the conical portion providing a transition between a central portion and an inner ram air fan hub interface portion, the conical portion comprising a plurality of inner cooling slots having a substantially elongated kidney shape with a slot arc length and spaced apart by a slot spacing angle, wherein a ratio of the slot spacing angle to the slot arc length is between 1.23 and 1.4;

a recessed portion located between the inner ram air fan hub interface portion and an outer ram air fan hub interface portion, the recessed portion comprising a plurality of outer cooling holes that are each substantially circular, wherein a ratio of a total outer cooling area of the outer cooling holes to a total inner cooling area of the inner cooling slots is between 1.242 and 1.419; and a ram air fan inlet shroud centerline and an origin point that is flush with the outer ram air fan hub interface portion along the ram air fan inlet shroud centerline, and a slot centerline of each of the inner cooling slots is offset from the origin point, wherein a ratio of an angle of each of the outer cooling holes to the origin point and an angle of each of the inner cooling slots to the origin point is between 1.87 and 2.14.

5. The ram air fan assembly of claim 4, wherein the offset is 0.100 inches (0.254 cm), and a width of each of the inner cooling slots is 0.28 inches (0.711 cm).

6. The ram air fan assembly of claim 4, wherein the outer cooling holes comprise eleven equally spaced holes, each having a diameter of 0.375 inches (0.9525 cm) and positioned around an outer cooling hole placement circle having a diameter of 2.4 inches (6.10 cm).

7. A method of installing a ram air fan inlet shroud in a ram air fan assembly for an aircraft, the method comprising:

arranging the ram air fan inlet shroud proximate to a ram air fan hub coupled to a plurality of fan blades configured to extend at least partially across a ram air fan inlet of the ram air fan assembly;

positioning a tie rod through the ram air fan inlet shroud and the ram air fan hub along a ram air fan centerline within an interior portion of a ram air fan shaft; and establishing a plurality of flow paths for a cooling flow in the ram air fan assembly including through a plurality of inner cooling slots and outer cooling holes in the ram air fan inlet shroud, wherein the ram air fan inlet shroud further comprises:

a shroud portion extending outwardly from a conical portion, the conical portion providing a transition between a central portion and an inner ram air fan hub interface portion, the conical portion comprising the plurality of inner cooling slots having a substantially elongated kidney shape with a slot arc length and spaced apart by a slot spacing angle, wherein a ratio of the slot spacing angle to the slot arc length is between 1.23 and 1.4;

a recessed portion located between the inner ram air fan hub interface portion and an outer ram air fan hub interface portion, the recessed portion comprising the plurality of outer cooling holes that are each substantially circular, wherein a ratio of a total outer cooling area of the outer cooling holes to a total inner cooling area of the inner cooling slots is between 1.242 and 1.419; and a ram air fan inlet shroud centerline and an origin point that is flush with the outer ram air fan hub interface portion along the ram air fan inlet shroud centerline, and a slot centerline of each of the inner cooling slots is offset from the origin point, wherein a ratio of an angle of each of the outer cooling holes to the origin point and an angle of each of the inner cooling slots to the origin point is between 1.87 and 2.14.

8. The method of claim 7, wherein the offset is 0.100 inches (0.254 cm), and a width of each of the inner cooling slots is 0.28 inches (0.711 cm).

9. The method of claim 7, wherein the outer cooling holes comprise eleven equally spaced holes, each having a diameter of 0.375 inches (0.9525 cm) and positioned around an outer cooling hole placement circle having a diameter of 2.4 inches (6.10 cm).

* * * * *